US005423502A

United States Patent [19]

Thomason et al.

[11] Patent Number: 5,423,502

[45] Date of Patent: Jun. 13, 1995

[54] APPARATUS FOR POSITIONING A SEWING WORK STATION AND METHOD OF USING SAME

[75] Inventors: David Thomason; Hideho Sasamoto, both of Lawrenceville, Ga.

[73] Assignee: Juki America, Inc., Suwanee, Ga.

[21] Appl. No.: 943,898

[22] Filed: Sep. 11, 1992

[51] Int. Cl.[6] ..... A47B 9/00

[52] U.S. Cl. ..... 248/125; 248/188.4; 248/188.5; 248/161; 108/159; 108/146

[58] Field of Search ..... 248/188.1, 188.2, 188.4, 248/188.5, 125, 161, 157; 108/146, 147, 159

[56] References Cited

U.S. PATENT DOCUMENTS

| | | | |
|---|---|---|---|
| 369,124 | 8/1887 | Powers | 248/157 |
| 3,007,014 | 10/1961 | Bentman | 248/161 |
| 3,587,482 | 6/1971 | Wieland . | |
| 3,908,565 | 9/1975 | Burnett | 108/147 |
| 3,932,009 | 1/1976 | Zollinger | 108/147 |
| 4,576,352 | 3/1986 | Ogden | 248/188.4 |
| 4,593,874 | 6/1986 | Dunagan . | |
| 4,981,085 | 1/1991 | Watt | 248/162.1 |
| 5,088,421 | 2/1992 | Beckstead | 108/147 |

*Primary Examiner*—Richard K. Seidel
*Assistant Examiner*—Allan M. Schrock
*Attorney, Agent, or Firm*—Morgan & Finnegan

[57] ABSTRACT

The invention is a readily adjustable work station. The invention includes a manual or machine driven linkage for adjusting the vertical position of a work station top surface in a level manner. This linkage includes rack and gear sets associated with movable supporting columns that support the work station top surface and a rotational transfer means that ensures that rotational energy from a driving means is evenly imparted to the rack and gear sets. Alternatively, the mechanical linkage may comprise ball plunger screws rather than rack and gear sets.

The invention also includes an apparatus for manually adjusting the angular orientation of the work station top surface, and an apparatus for adjusting the clearance between the stationary support structure and the movable support structure.

2 Claims, 8 Drawing Sheets

APPARATUS FOR POSITIONING A SEWING WORK STATION AND METHOD OF USING SAME

FIELD OF THE INVENTION

This invention relates to an apparatus for positioning a work station used for supporting sewing machines or other machinery used in sewing operations. More particularly, this invention relates to a manual or machine-driven apparatus for adjusting the vertical and angular position of the work station surface. The invention also relates to the method of using the apparatus to adjust the vertical and angular position of the work station surface.

BACKGROUND OF THE INVENTION

The top surfaces of stationary tables have long been used to support sewing machines or other machinery used in sewing operations. A sewing machine so supported would most likely not be ideally positioned for the operator's comfort during use. The long-term use of an unsuitably positioned sewing machine can result, for example, in physical discomfort and strain for the operator or, in extreme cases, "cumulative trauma injuries".

The need for a work station that was adjustable, both vertically and angularly, to a comfortable position for the operator has been recognized. Conventionally, as known in the art, the so-called adjustable work station has a top surface that is vertically adjustable by two cylinders located on either side of the station. Typically, these cylinders are driven in the vertical direction by hydraulic or pneumatic means.

The adjustable work stations as known in the art, suffer several disadvantages. First, it is difficult to maintain equal levels of flow of the hydraulic or pneumatic working fluid to the two separate cylinders. An uneven flow of the working fluid to the cylinders will result in one side of the work station surface being raised higher than the other side. An unlevel work station surface is undesirable. Second, hydraulic and pneumatic systems are prone to leakage. Leakage in one cylinder but not in the other will result in an unlevel work station surface. Moreover, leakage of hydraulic fluids is detrimental in that it can cause damage or soiling of the workpiece materials being sewn by the sewing machine operator.

OBJECTS OF THE INVENTION

It is, therefore, an object of the present invention to provide an apparatus which is capable of evenly adjusting the vertical height of a work station surface so as to maintain a level work surface.

It is a further object of the present invention is to provide an apparatus which will control the angular adjustment of a work station surface.

It is yet another object of the present invention to provide an apparatus for adjusting the vertical height and angular adjustment of a work station surface which alleviates physical discomfort suffered by operators during long-term use of the work station.

It is still an additional object of the present invention to provide an apparatus for adjusting the vertical height and angular adjustment of a work station surface which will not cause soiling or damage to workpiece components being processed at the work station.

SUMMARY OF THE INVENTION

These and other objects of the invention are met by providing an apparatus and method according to the invention.

As contemplated, one embodiment of the invention comprises a work station top surface, which is supported by two supporting columns slidably disposed within two supporting structures. The two supporting columns are sychronously vertically raised or lowered by a mechanical linkage system consisting of two rack and gears sets, a rotational transfer means, and a shaft driven either directly or indirectly by a handcrank or an electric motor.

Another embodiment of the invention involves using an electric motor to drive the linkage to synchronously raise or lower the two supporting columns. In this embodiment, the mechanical linkage consists of a threaded shaft associated with each supporting column and a rotational transfer means for evenly transmitting the rotational energy from the electric motor to the two supporting columns.

Another embodiment of the invention comprises an apparatus for manually adjusting the angular orientation of the work station top surface. In this embodiment, the top surface is pivotally mounted to the two supporting columns. The angular adjustment of the top surface about the supporting columns is controlled by a handcrank via a mechanical linkage arrangement. It will be apparent that the shaft may be driven by an electric motor rather than a handcrank.

BRIEF DESCRIPTION OF THE DRAWINGS

The invention will be described in greater detail below by way of reference to the following drawings, wherein.

DETAILED DESCRIPTION OF THE DRAWINGS

Figure 1:
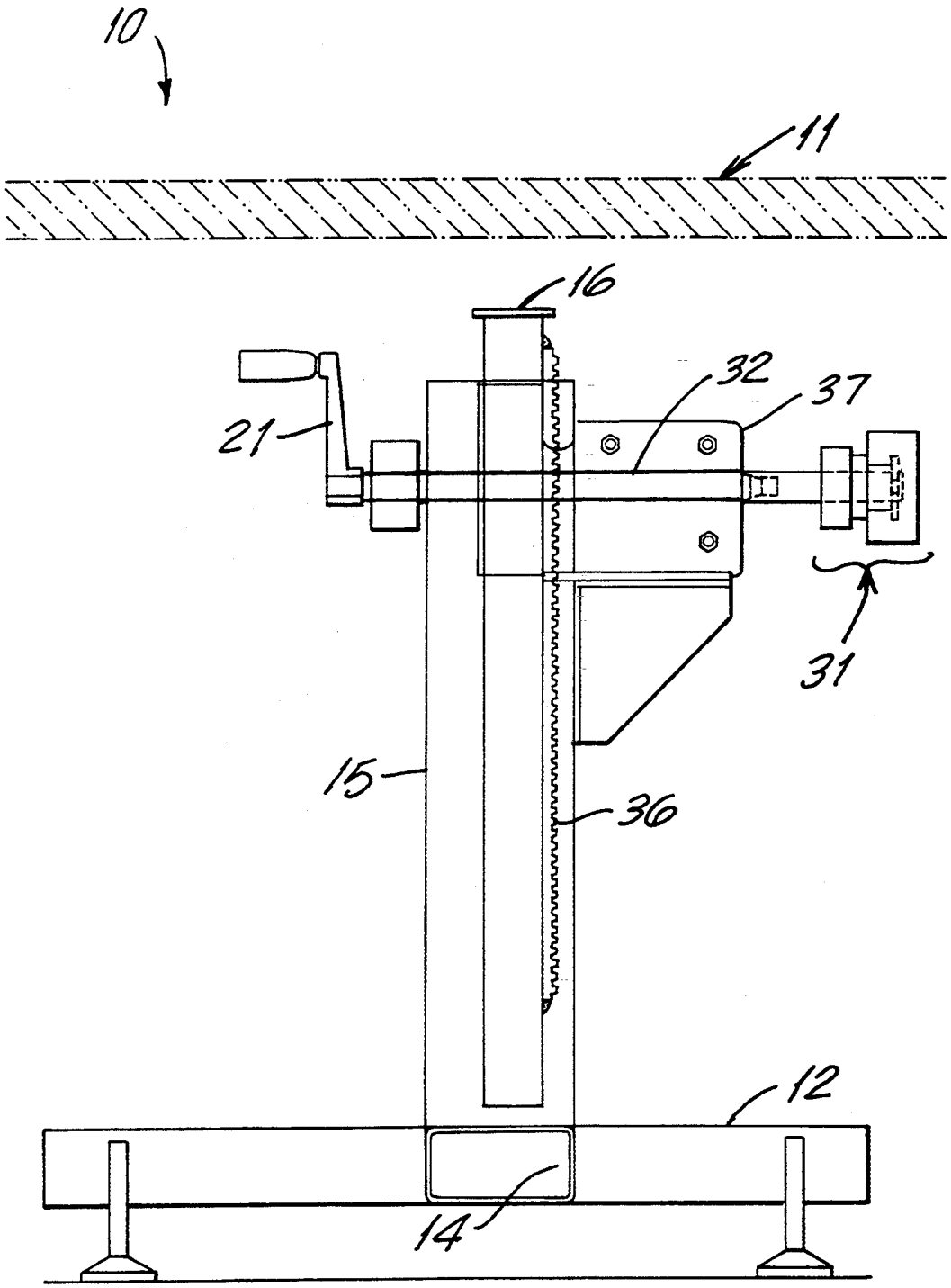
FIG. 1 is a side view of one embodiment of a work station according to the present invention with a handcrank-driven apparatus for adjusting the vertical height of the work station top surface.
Figure 2:
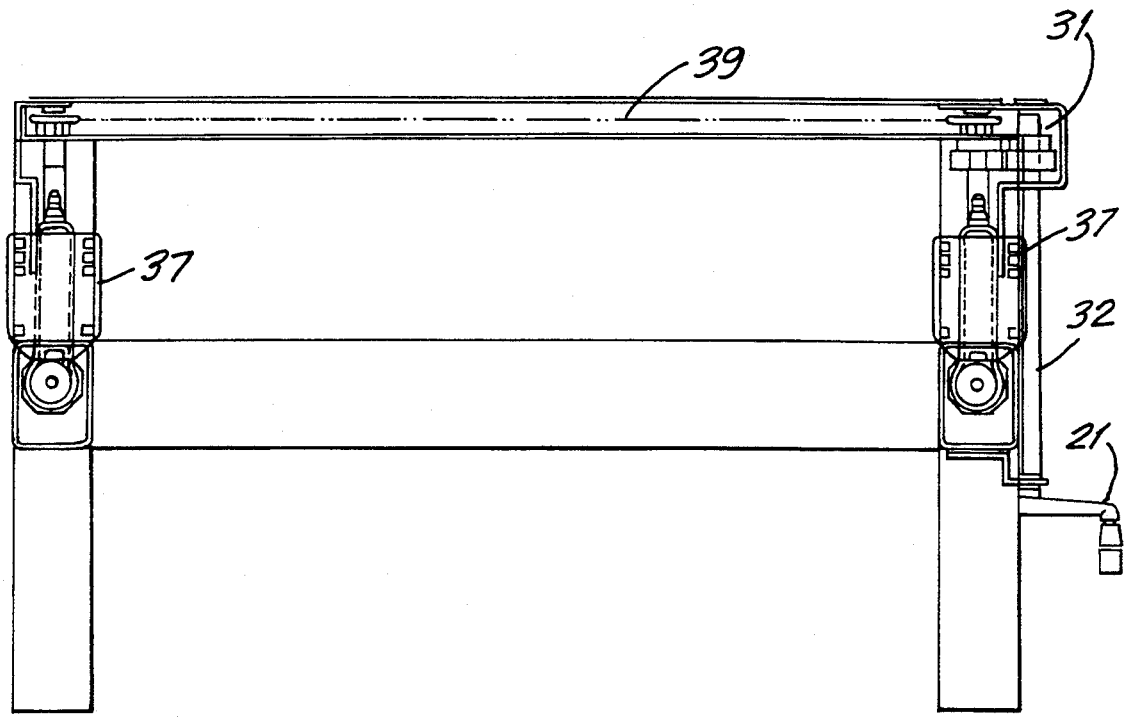
FIG. 2 is a top view of the handcrank-driven apparatus shown in FIG. 1 for adjusting the vertical height of the work station top surface.

FIGS. 1 and 2 illustrate one embodiment of a work station 10 according to the present invention. Workstation 10 includes a top surface 11 which is mounted on an adjustable support structure 20. The support structure 20 comprises two base support beams 12 which are attached to either end of a cross-beam 14. Two hollow vertical supporting structures 15 are vertically mounted on the base support beams 12. A supporting column 16 is slidably disposed within each of the vertical supporting structures 15. The top surface 11 is mounted on the tops of the supporting columns 16.

Figure 4:
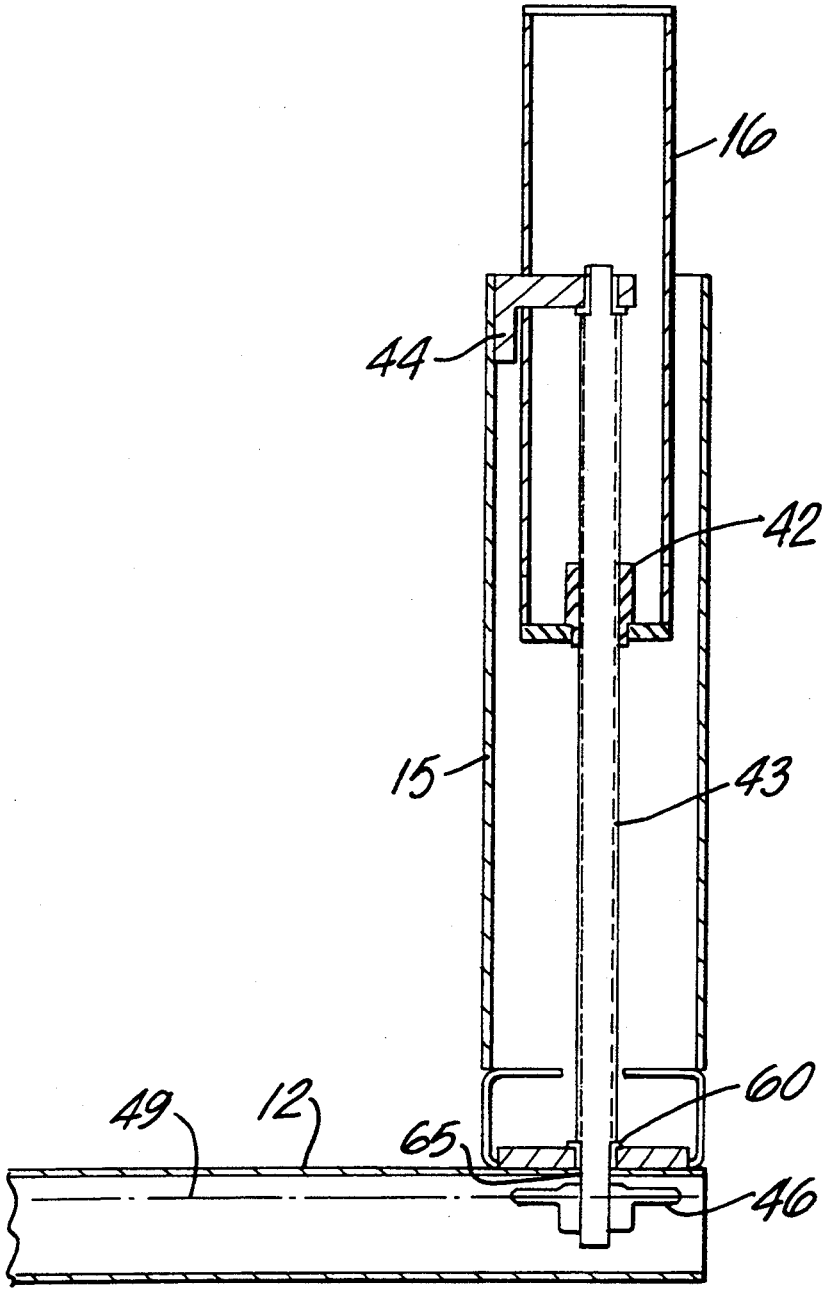
FIG. 4 is a sectional view of the electric motor-driven apparatus illustrated in FIG. 3 for adjusting the vertical height of the work station top surface.
Figure 4A:
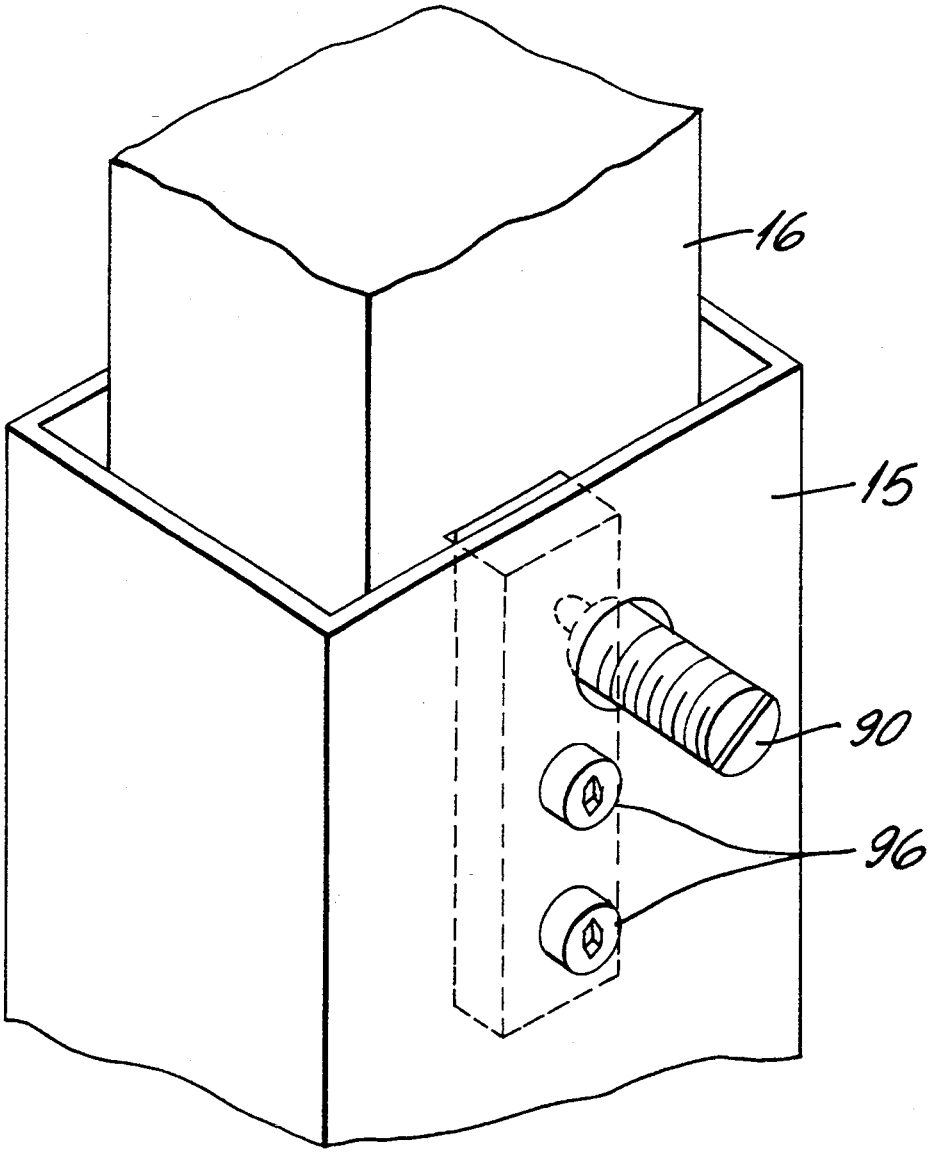
FIG. 4A illustrates an apparatus for reducing the clearance between the vertical support structures and the vertical support columns shown in the embodiments of FIGS. 1–4.

As shown in FIG. 4A, a conventional ball plunger screw 90 may be rotatably threaded through vertical supporting structure 15 to pressingly engage a pad 94 resting against supporting column 16. The pad 94 itself is secured to the vertical supporting structure 15 by screws 96. By rotating the ball plunger screw 90, the operator may press the pad 94 against supporting column 16, or adjustably release pad 94 from its pressing engagement with supporting column 16, to adjust the clearance between the vertical support structure 15 and the supporting column 16. By adjusting this clearance, the operator can prevent any wobbling, shaking, or other de-stablizing motion between vertical supporting structure 15 and supporting column 16.

The vertical height of the top surface 11 may be adjusted while simultaneously maintaining the top surface 11 level by synchronously adjusting the vertical position of the supporting columns 16 within each of the vertical supporting structures 15. The synchronous movement of the supporting columns is accomplished through a mechanical linkage system as herein described below. The mechanical linkage may be driven by a manual arrangement or can be driven with an electric motor.

The handcrank-driven linkage and the process of synchronously adjusting the vertical height of the support columns 16 will be explained by referring to FIG. 1 and FIG. 2. In operation an operator imparts rotational energy to the linkage by manually turning a handcrank 21 rotatably mounted to one of the vertical supporting structures 15. The handcrank 21 is attached to a shaft 32 which in turn is coupled to a rotational transfer means 31. Thus, the rotational energy imparted to the handcrank 21 is transmitted to the rotational transfer means 31.

Figure 2A:
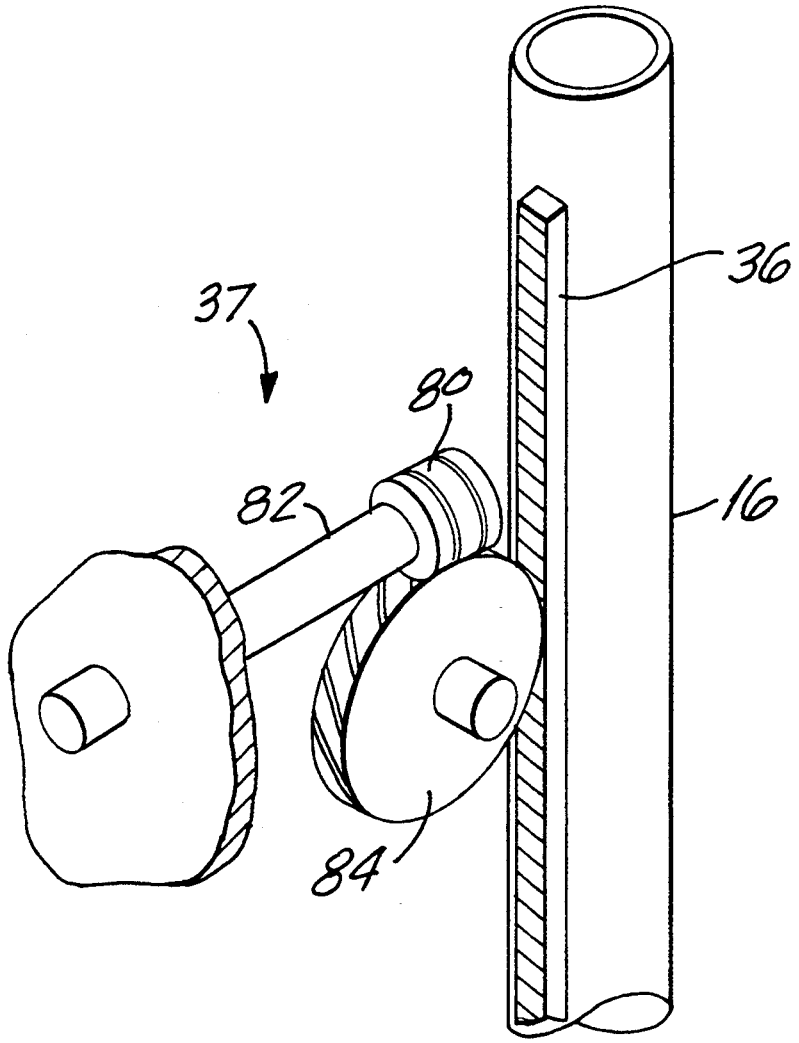
FIG. 2A is a cut away schematic illustrating the meshing between the worm and worm gear set and the rack illustrated in the embodiment of FIGS. 1 and 2.

Each supporting column 16 has a rack 36 vertically affixed to its outer surface. Each rack 36 is engaged by a worm and worm gear set 37. As known to those skilled in the art and illustrated in FIG. 2A, the worm and worm gear set 37 may include, for example, a worm 80, driven by a shaft 82, which rotatably meshes with worm gear 84. Worm gear 84 itself is meshingly engaged with the rack 36. Shaft 82 is coupled to a secondary shaft (not shown) which is actuated by rotating the handcrank 21. Thus, by rotating handcrank 21, shaft 82 rotates, causing worm 80 to turn worm gear 84 to thus raise (or lower) supporting column 16 via the rack 36.

As shown, the rotational transfer means 31 includes a drive means 39, such as a chain or toothed belt, which is coupled to the two worm and worm gear sets 37. The rotational transfer means 31, together with the drive means 39, ensure that the rotational energy from the handcrank 21 is evenly imparted to the two worm and worm gear sets 37, ensuring that both supporting columns 16 rise (or fall) synchronously.

An even transmission of the rotational energy to the worm and worm gear sets 37 will ensure that the two racks 36 will be synchronously engaged. Thus, depending on which way the handcrank 31 is turned, the top surface 11 will be raised or lowered in a level fashion.

Figure 2B:
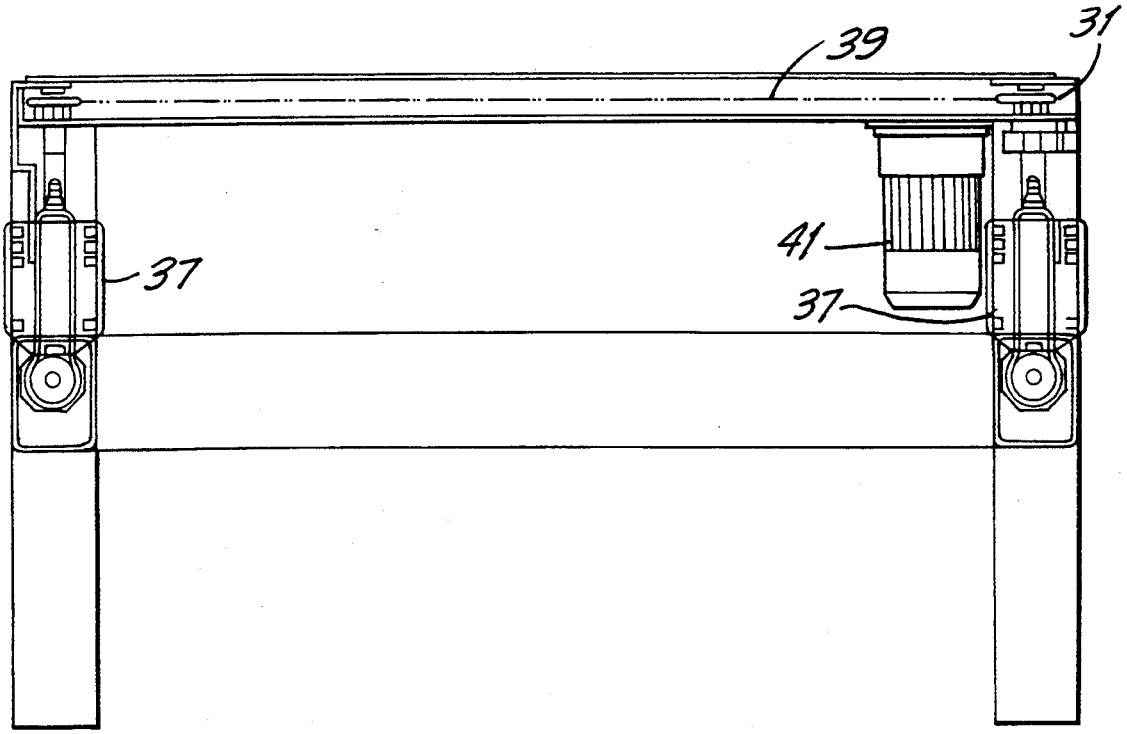
FIG. 2B is a top view of the electric motor-driven apparatus for adjusting the vertical height of the work station top surface.

Alternatively, as shown in FIG. 2B, the handcrank 31 and shaft 32 may be replaced by an electric motor 41. The linkage operates in the manner described above except that the rotational energy from electric motor 41 is imparted directly to the rotational transfer means 31.

Figure 3:
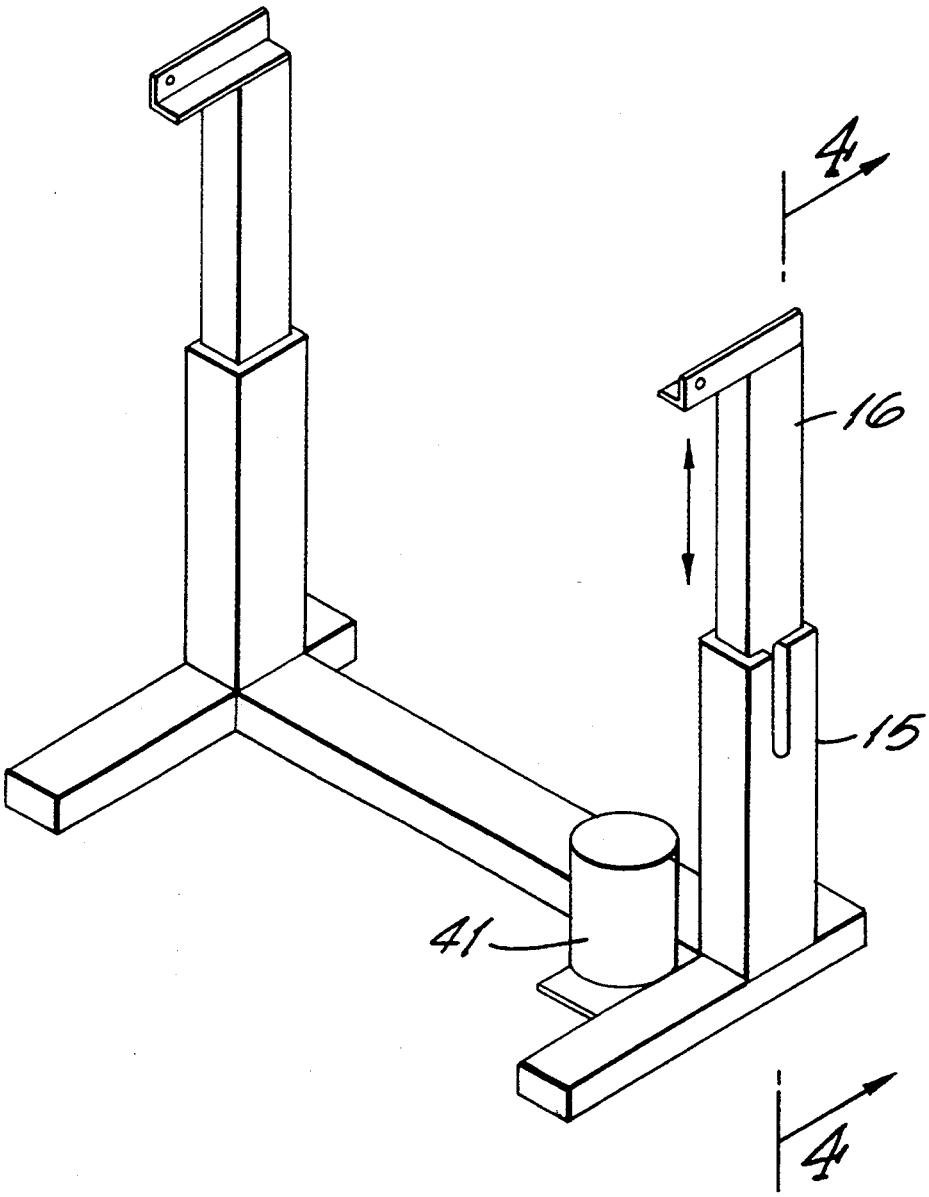
FIG. 3 is a schematic view of a second embodiment a work station according to the present invention with an electric motor-driven apparatus for adjusting the vertical height of the work station top surface.

FIG. 3 and FIG. 4 illustrates an alternative embodiment of a workstation according to the present invention wherein the top surface 11 is vertically adjusted by an electric motor 41. In this embodiment, a different mechanical linkage is employed by synchronously altering within the vertical supporting structures 15 the vertical position of the supporting columns 16. As with the embodiment described in FIGS. 1 and 2, the embodiment of FIGS. 3–4 may include the conventional ball plunger screw 90 illustrated in FIG. 4A for eliminating destabilizing motion between supporting structure 15 and column 16.

Each supporting column 16 has a threaded aperture 42 in its bottom end. There are also apertures 60 through the base of the vertical supporting structures 15 and apertures 65 through the top of base support beams 12. A rotatable threaded shaft 43 extends through the threaded aperture 42. One end of the threaded shaft 43 is rotatably supported within the hollow supporting column 16 by a shaft supporting structure 44. The other end of the threaded shaft is supported within the base support beam 12. As configured, rotation of the threaded shaft 43 will cause the supporting column 16 to be raised or lowered depending on the direction of the threads.

The electric motor 41 is coupled to a rotational transfer means 46 which is attached to the base of the threaded shafts 43. The rotational transfer means 46 includes a drive means 49, such as a chain or a belt, connecting the two threaded shafts 43 so that the rotational energy imparted by the electric motor 41 is evenly transmitted to the two threaded shafts 43. An even transmission of the rotational energy to the two threaded shafts will ensure that the supporting columns 16 will be synchronously raised or lowered.

Advantageously, the linkage can be sized so that the top surface 11 can be raised about sixteen inches from its lowest position. In use, a $\frac{1}{4}$ horsepower AC electrical motor will be sufficient to raise and lower a standard top surface 11 upon which rests a conventional sewing machine. However, depending upon the load supported by the work station, it may be possible to use a smaller motor. The operation of the electrical motor 41 may be controlled by switches known in the art.

Figure 5:
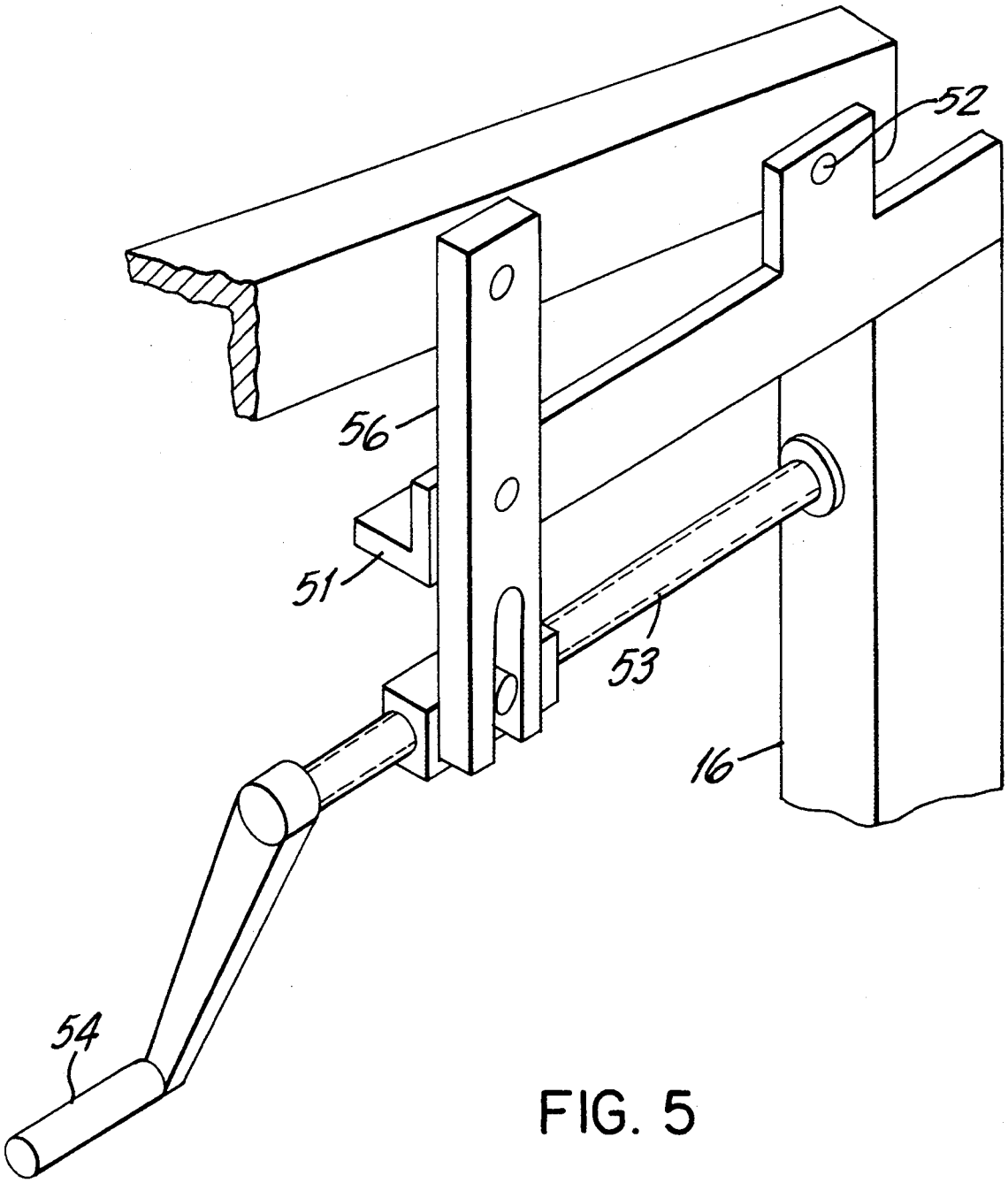
FIG. 5 is a schematic view of a handcrank driven apparatus according to the present invention for angularly adjusting a work station top surface.

FIG. 5 shows another embodiment of a workstation according to the present invention by which the angular orientation of the top surface 11 may be manually adjusted.

Top surface 11 is mounted on brackets 51 which are pivotably attached to the supporting columns 16 and are rotatable about pivot 52. A threaded shaft 53 is rotatably supported at one end by the supporting column 16. A handcrank 54 is attached to the opposite end of the threaded shaft 53. A linkage means 56 couples the pivotable bracket 51 and the threaded shaft 53 such that a rotation of the threaded shaft 53 through the rotation of handcrank 54 results in the top surface 11 to be angularly adjusted through $\pm 15°$ from horizontal.

It will be apparent that other and further forms of the invention may be devised without departing from the spirit and scope of the appended claims, it being understood that this invention is not to be limited to the specific embodiments shown.

What is claimed is:

1. A device for vertically positioning a work station top surface, comprising:

two hollow vertical supporting structures;

two hollow supporting columns, each of which define a threaded aperture therein and is slidably disposed within one of the hollow vertical supporting structures and there being a clearance between each supporting column and each respective hollow vertical supporting structure;

two threaded shafts each of which is threadedly engaged with and extends through one of the threaded apertures in one of the support columns and is rotatably supported at one end within one of the supporting columns so that rotation of the threaded shafts will cause a vertical displacement of the associated supporting columns;

an electric motor;

rotational transfer means coupling the electric motor to the two threaded shafts so that the rotational energy from the electric motor will be evenly transmitted to the two threaded shafts;

clearance adjusting means for adjusting the clearance between said vertical supporting structures and said supporting columns; and angular orientation means for adjusting the angular orientation of the work station top surface, said means comprising:

(a) two brackets on which the top surface is mounted, each bracket is pivotally attached to one of the supporting columns;

(b) a third threaded shaft rotatably mounted to one of the supporting columns;

(c) cranking means for transmitting rotational energy to the third threaded shaft; and (d) linkage means coupling one of the pivotable brackets to the threaded shaft so that a rotation of the third threaded shaft causes said one bracket to pivot.

2. A device for vertically positioning a work station top surface, comprising:

two hollow vertical supporting structures;

two supporting columns for supporting the top surface, each with a rack vertically affixed to an outer surface thereof and each slidably disposed within a respective one of the two hollow vertical supporting structures and there being a clearance between each supporting column and each respective hollow vertical supporting structure;

two worm and worm gear sets, each gear set being engaged with a respective rack of the supporting columns;

a rotational transfer means coupled to the two gear sets such that any rotational energy transmitted to the rotational transfer means is evenly imparted to the racks and gear sets;

a shaft coupled to the rotational transfer means so that any rotational energy transmitted to the shafts is transmitted to the rotational transfer means;

means for transmitting rotational energy to the shaft; and means for adjusting the clearance between said vertical supporting structures and said supporting columns.

* * * * *